US009407032B1

(12) United States Patent
Song et al.

(10) Patent No.: US 9,407,032 B1
(45) Date of Patent: Aug. 2, 2016

(54) WATERPROOF DEVICE FOR CONNECTOR JOINT

(71) Applicant: IDIS CO., LTD., Daejeon-si (KR)

(72) Inventors: Jin Kyu Song, Seoul (KR); Kyoung Ju Jeong, Suwon-si (KR)

(73) Assignee: IDIS CO., LTD., Daejeon (KR)

( * ) Notice: Subject to any disclaimer, the term of this patent is extended or adjusted under 35 U.S.C. 154(b) by 0 days.

(21) Appl. No.: 14/877,279

(22) Filed: Oct. 7, 2015

(30) Foreign Application Priority Data

Jul. 30, 2015 (KR) ..... 10-2015-0108291

(51) Int. Cl.
*H01R 13/52* (2006.01)

(52) U.S. Cl.
CPC ..... *H01R 13/5219* (2013.01); *H01R 13/5205* (2013.01)

(58) Field of Classification Search
CPC ..... H01R 13/5205; H01R 13/5219; H01R 13/5202; H01R 13/5221
USPC ..... 439/271, 272, 278, 279, 587
See application file for complete search history.

(56) References Cited

U.S. PATENT DOCUMENTS 7,597,579 B2 * 10/2009 Ikeya ..... H01R 13/5213 439/278
7,789,689 B2 * 9/2010 Frey ..... H01R 13/523 439/275
7,828,573 B2 * 11/2010 Butaud ..... H01R 13/523 439/523
8,092,240 B2 * 1/2012 Houir Alami ..... H01R 13/4538 439/278
8,702,440 B2 * 4/2014 Nooner ..... H01R 13/5213 439/279

FOREIGN PATENT DOCUMENTS

| | | | |
|---|---|---|---|
| JP | 6-68243 | A | 3/1994 |
| JP | 8-242519 | A | 9/1996 |
| JP | 2001-245424 | A | 9/2001 |
| KR | 20-2008-0003661 | U | 9/2008 |
| KR | 10-1152933 | B1 | 5/2012 |

OTHER PUBLICATIONS

Korean Office Action issued on Jun. 16, 2016 in counterpart Korean Patent Application No. 10-2015-0108291 (4 pages in Korean).

* cited by examiner

*Primary Examiner* — Khiem Nguyen
(74) *Attorney, Agent, or Firm* — NSIP Law

(57) ABSTRACT

Disclosed is a waterproof device for a connector joint. The waterproof device, which seals a joint of a modular jack and a connector to waterproof the joint, includes: a body portion having a hollow inner portion, and a connection groove which is formed on an inner circumference of one end of the body portion, and is shaped corresponding to the modular jack so that the modular jack is coupled and fixed to the body portion; and an elastic member formed to surround an outer circumference of the body portion and to have an insertion portion having a connector inserting hole which is formed on a side opposite to a side where the modular jack is coupled, and through which the connector passes, wherein after the connector passes therethrough, the cable of the connector is pressed against the connector inserting hole to seal an inside of the body portion.

5 Claims, 6 Drawing Sheets

WATERPROOF DEVICE FOR CONNECTOR JOINT

CROSS-REFERENCE TO RELATED APPLICATION(S)

This application claims priority from Korean Patent Application No. 10-2015-0108291, filed on Jul. 30, 2015, in the Korean Intellectual Property Office, the entire disclosure of which is incorporated herein by reference for all purposes.

BACKGROUND

1. Field

The following description generally relates to a waterproof device for a connector joint, and more particularly to a waterproof device for a connector joint, which seals a joint of a modular jack and a connector.

2. Description of the Related Art

When closed-circuit (CC) TV cameras are installed, an RJ45 modular jack and an RJ45 connector are generally connected for data transmission. However, when the CCTV cameras are installed in an outdoor environment, the joint of an RJ45 modular jack and an RJ45 connector is exposed to the outside such that a failure in the CCTV camera may occur due to moisture from rain and the like. Accordingly, a waterproof device is used to waterproof the connector joint.

FIG. 1 illustrates an embodiment of such waterproof device for a connector joint. As illustrated in FIG. 1, the waterproof device for a connector joint includes a connector protective cover 1, a back cover 2, and a cable waterproofing gasket 3. The waterproof device for a connector joint is operated in such a manner that: a cable C is sequentially inserted into the back cover 2, the cable waterproofing gasket 3, and the connector protective cover 1, and then the cable C is connected with the connector 4; after joining the connector 4 connected to the cable C to the module jack 5, the connector protective cover 1 is turned clockwise to be connected to the modular jack 5; and the back cover 2 is similarly turned clockwise to be connected to the connector protective cover 1. In this manner, when the back cover 2 is connected, the cable waterproofing gasket 3 is pressed to the cable, thereby enabling waterproofing.

However, such general waterproof device for a connector joint, as disclosed in Korea Patent No. 10-1152933 (May 29, 2012), has drawbacks in that various components are required, which increases the cost of parts, and an assembly process becomes complicated, thereby reducing productivity. Further, since the cable C is connected to the connector after being inserted into all the components of a waterproof device for a connector joint, a process of connecting the cable with the connector may not be performed in advance but should be performed on the spot of installation, such that equipment for installation should be carried all the time.

SUMMARY

Disclosed is a waterproof device for a connector joint, which has a simple structure and can be installed even after a cable and a connector are connected in advance.

In one general aspect, there is provided a waterproof device for a connector joint, the device sealing a joint of a modular jack and a connector to waterproof the joint and including: a body portion having a hollow inner portion, and a connection groove which is formed on an inner circumference of one end of the body portion, and is shaped corresponding to the modular jack so that the modular jack is coupled and fixed to the body portion; and an elastic member formed to surround an outer circumference of the body portion and to have an insertion portion having a connector inserting hole which is formed on a side opposite to a side where the modular jack is coupled, and through which the connector passes, wherein after the connector passes therethrough, the cable of the connector is pressed against the connector inserting hole to seal an inside of the body portion.

The insertion portion may be concavely formed toward the modular jack.

The elastic member may be made of a silicone rubber.

The body portion and the elastic member may be integrally formed.

Figure 1:
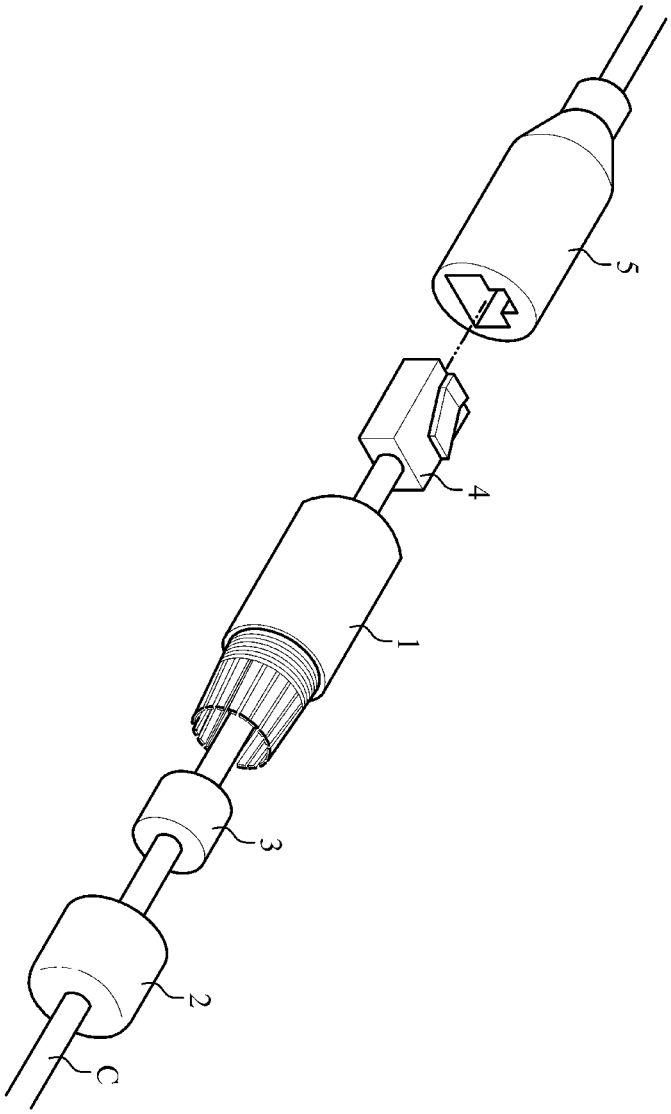
FIG. 1 is a view illustrating a general waterproof device for a connector joint.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Hereinafter, the present disclosure will be described in detail with reference to the example embodiment shown in the accompanying drawings.

The waterproof device for a connector joint is a device for sealing a joint of a modular jack, which is a female connector, and a connector, which is a male connector, so that the joint may be waterproofed. The modular jack may be an RJ45 modular jack, and the connector corresponding to the modular jack may be an R45 connector.

Figure 2:
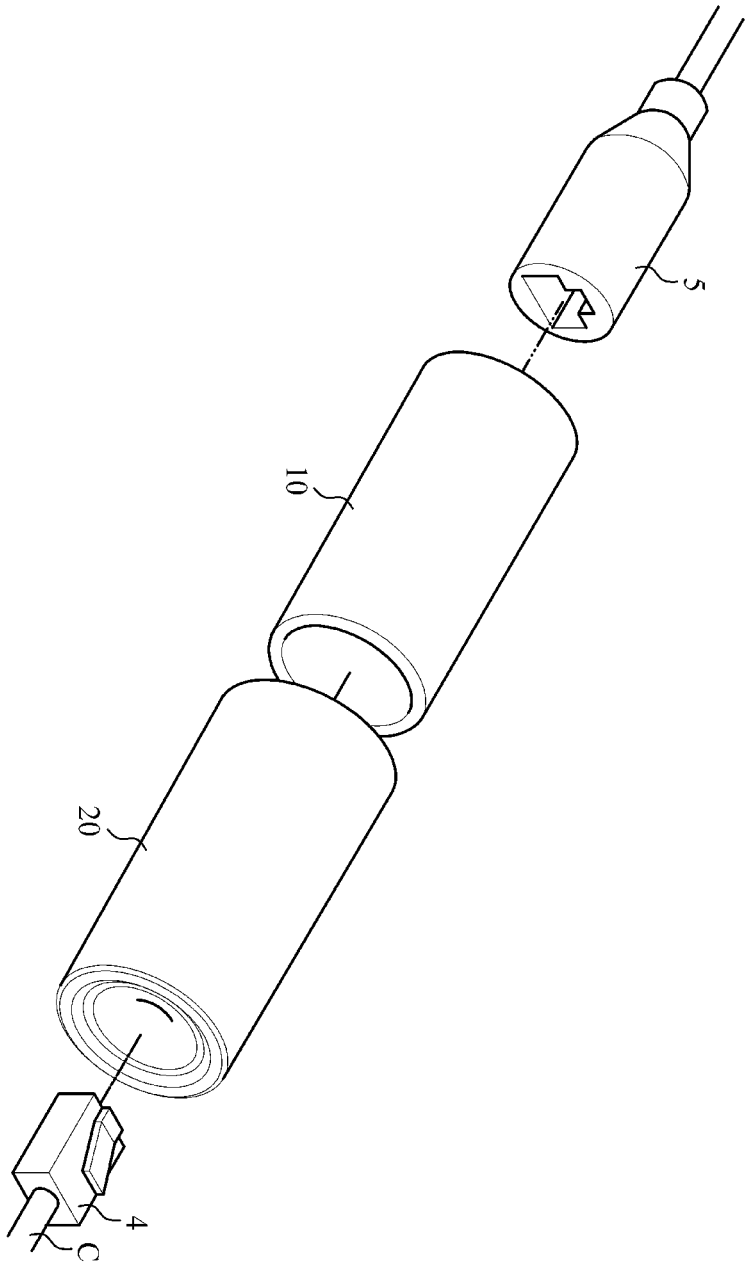
FIG. 2 is a perspective view illustrating an example of using a waterproof device for a connector joint according to an exemplary embodiment.
Figure 3:
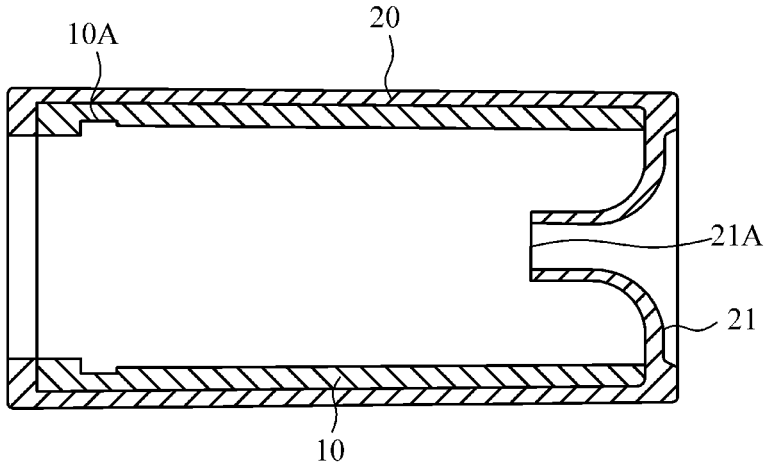
FIG. 3 is a cross-sectional view illustrating the waterproof device for a connector joint illustrated in FIG. 2.
Figure 4:
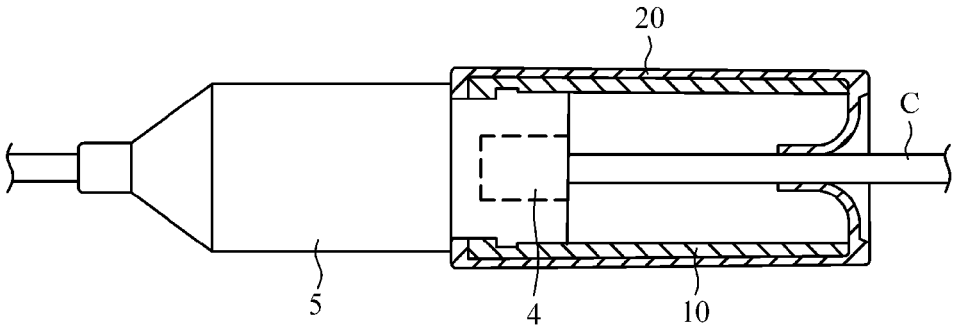
FIG. 4 is a cross-sectional view illustrating an example of using the waterproof device for a connector joint illustrated in FIG. 2.

FIG. 2 is a perspective view illustrating an example of using a waterproof device for a connector joint according to an exemplary embodiment, FIG. 3 is a cross-sectional view illustrating the waterproof device for a connector joint illustrated in FIG. 2, and FIG. 4 is a cross-sectional view illustrating an example of using the waterproof device for a connector joint illustrated in FIG. 2.

Referring to FIGS. 2 to 4, the waterproof device for a connector joint includes a body portion 10 and an elastic member 20.

The body portion 10 has a hollow inner portion. A connection groove 10*a* is formed on the inner circumference of one end of the body portion 10, and is shaped corresponding to the modular jack, so that the modular jack may be coupled and fixed to the body portion 10. The body portion 10 may have a cylindrical shape with a circular inner and outer circumferences. However, the body portion 10 is not limited thereto, and may have other shapes according to the outer shape of a connector. The body portion 10 may be injection-molded or extrusion-molded.

The elastic member 20 is formed to surround the outer circumference of the body portion 10. An insertion portion 21 has a connector inserting hole 21*a* which is formed on a side opposite to the side where the modular jack 5 is coupled, and through which the connector 4 may pass, in which after the connector 4 passes therethrough, the cable C of the connector 4 is pressed against the connector inserting hole 21*a* such that the inside of the body portion may be sealed. Since the connector inserting hole 21*a* presses the cable C after the connector 4 is inserted into the connector inserting hole 21*a*, the connector inserting hole 21*a* may be formed to have a diameter identical to or smaller than the diameter of the cable C. Further, the connector inserting hole 21*a* may have a circular shape, but is not limited thereto, and may have a square shape or a triangle shape.

As described above, the waterproof device for a connector joint may have a simple structure to waterproof a joint of the modular jack 5 and the connector 4, such that the cost of parts may be reduced, and an assembly process may be easily performed, thereby improving productivity. Further, a waterproofing process may be performed even when a cable and a connector are connected in advance, thereby facilitating the process.

As illustrated in FIGS. 2 to 4, the insertion portion 21 may be concavely formed toward the modular jack 4. In the case where the insertion portion 21 is concavely formed toward the modular jack 4, the connector 4 may be easily inserted into the connector inserting hole 21*a*, and the cable C may be pressed against the connector inserting hole 21*a* after the connector 4 is inserted thereinto, such that the inside of the body portion may be tightly sealed.

Further, the body portion 10 may be integrally formed with the elastic member 20. The body portion 10 and the elastic member 20 may be integrally formed by double injection molding, or the body portion 10 formed in advance may be inserted into a mold, and then the elastic member 20 may be injection molded. In the case where the body portion 10 and the elastic member 20 are integrally formed, there is no need to put together the body portion 10 and the elastic member 20, thereby facilitating installation.

Figure 5:
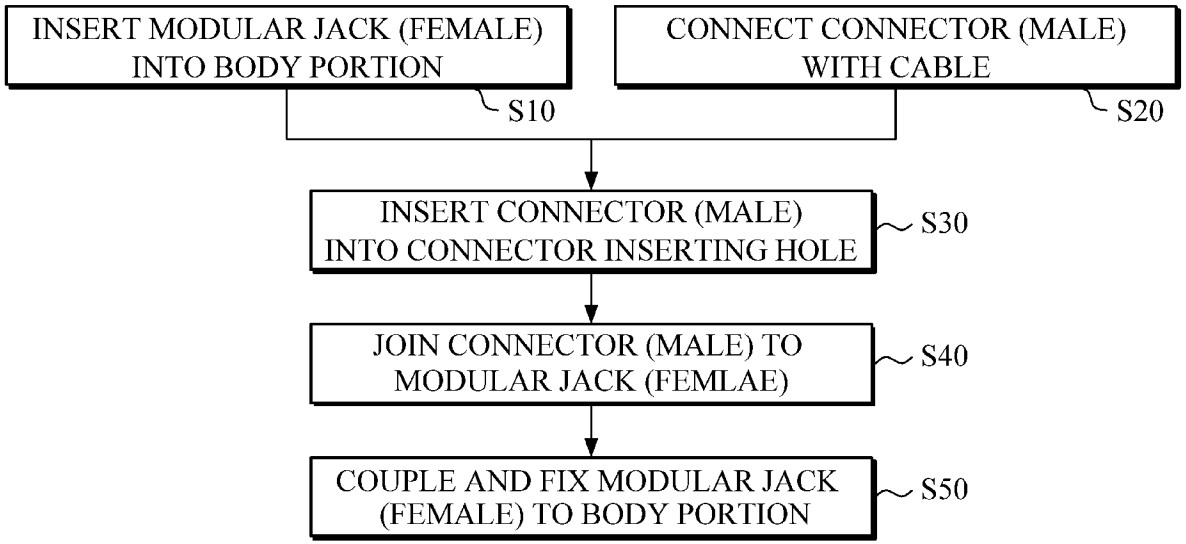
FIG. 5 is a flowchart illustrating a method of using a waterproof device for a connector joint according to an exemplary embodiment.

FIG. 5 is a flowchart illustrating a method of using a waterproof device for a connector joint according to an exemplary embodiment.

Referring to FIGS. 4 and 5, the method of using the aforementioned waterproof device for a connector joint will be described below.

Figure 6:
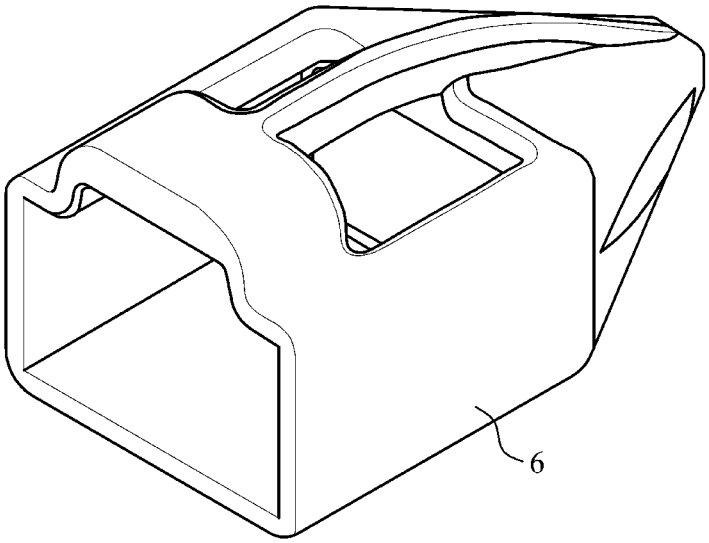
FIG. 6 is a view illustrating a tool to insert a modular jack into a housing of a waterproof device for a connector joint according to an exemplary embodiment.

First, the modular jack 5 is inserted into the housing 10 of the waterproof device for a connector joint in S10. A tool is necessary to easily insert the modular jack 5 into the housing 10, since the size of the modular jack 5 and the size of the opening of the hollow housing 10 are similar, such that it is not easy to insert the modular jack 5 into the housing 10 without using a tool, and when the modular jack 5 is inserted, the edges of the housing 10 may be damaged. As an example of such tool, FIG. 6 illustrates a jig 6. After the modular jack 5 is connected to one side of the jig 6, the jig 6 is inserted into the housing 10, starting from the other side that has a pointed portion. After the modular jack 5 is inserted into the housing 10, the jig 6 is discharged through the connector inserting hole 21*a*. The jig 6 may be made of a soft material.

Separately from the above process, the connector 4 is connected to the cable C in S20, in which the cable C may be a LAN cable, and the connector 4 may be an RJ45 connector. The connector and the cable C may be connected by using a LAN tool.

Then, the connector 4 connected with the cable C is inserted into the connector inserting hole 21*a* of the elastic member 20 in S30. Since the cable C is pressed against the connector inserting hole 21*a* after the connector 4 is inserted thereinto, the connector inserting hole 21*a* may be formed to have a diameter identical to or smaller than the diameter of the cable C. That is, the connector inserting hole 21*a* is formed to be smaller than the connector 4. However, the connector inserting hole 21*a* of the elastic member 20 is elastic, such that the connector 4 may be pressed into the connector inserting hole 21*a*.

Subsequently, the connector 4 is joined to the modular jack 5 in S40. In order to join the connector 4 and the modular jack 5, a user needs to check the inserting hole of the modular jack. Accordingly, the modular jack is required to be pressed as closest as possible to the connector inserting hole 21*a* to enable a user to check the inserting hole of the modular jack 5. Then, by holding the connector 4 with a right hand, and by pressing the connector 4 toward the modular jack 5, the connector 4 may be joined to the modular jack 5.

Next, the modular jack 5 is coupled and fixed to the body portion 20. By pulling the cable C of the modular jack 5 to move the modular jack 5 to the opposite side of the connector inserting hole 21*a*, the modular jack 5 may be coupled and fixed to the body portion 20. With the connection groove 10*a* which is formed on the inner circumference of one end of the body portion 10, and is shaped corresponding to the modular jack so that the modular jack may be coupled and fixed to the body portion 20, the modular jack 5 may be turned to be coupled and fixed to the body portion 20.

As described above, by using the waterproof device for a connector joint, an installation process may be easily performed even when a cable and a connector are connected in advance.

According to the present disclosure, as the waterproof device for a connector joint has a simple structure, such that the cost of parts may be reduced, and an assembly process may be easily performed, thereby improving productivity.

Further, the device may be easily installed even when a cable and a connector are connected in advance.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims. Further, the above-described examples are for illustrative explanation of the present invention, and thus, the present invention is not limited thereto.

What is claimed is:

1. A waterproof device for a connector joint, the device sealing a joint of a modular jack and a connector to waterproof the joint and comprising:

a body portion having a hollow inner portion, and a connection groove which is formed on an inner circumference of one end of the body portion, and is shaped corresponding to the modular jack so that the modular jack is coupled and fixed to the body portion; and an elastic member formed to surround an outer circumference of the body portion and to have an insertion portion having a connector inserting hole which is formed on a side opposite to a side where the modular jack is coupled, and through which the connector passes, wherein after the connector passes therethrough, the cable of the connector is pressed against the connector inserting hole to seal an inside of the body portion.

2. The device of claim 1, wherein the insertion portion is concavely formed toward the modular jack.

3. The device of claim 1, wherein the elastic member is made of a silicone rubber.

4. The device of claim 1, wherein the body portion and the elastic member are integrally formed.

5. The device of claim 1, wherein the modular jack is female and the connector is male.

* * * * *